US005966865A

United States Patent [19]

Jones

[11] Patent Number: 5,966,865

[45] Date of Patent: Oct. 19, 1999

[54] ATTACHMENT APPARATUS FOR A FLOWER HOLDER MODULE

[76] Inventor: Jill Marie Jones, 361 Beaver St., Leetsdale, Pa. 15056-1136

[21] Appl. No.: 09/049,704

[22] Filed: Mar. 28, 1998

[51] Int. Cl.[6] ..... A01G 5/00; A47G 7/00; A47B 96/06

[52] U.S. Cl. ..... 47/41.01; 47/39; 248/230.8; 248/218.4

[58] Field of Search ..... 47/39, 41.01, 41.13, 47/41.14, 41.15, 41.11; 248/230.8, 218.4, 205.2, 314, 27.8

[56] References Cited

U.S. PATENT DOCUMENTS

| | | | |
|---|---|---|---|
| D. 344,967 | 3/1994 | Webster | D16/136 |
| D. 363,689 | 10/1995 | Vitalune et al. | D11/148 |
| 4,026,508 | 5/1977 | Ziegler | 248/220.3 |
| 4,566,221 | 1/1986 | Kossin | 47/41.12 |
| 4,825,590 | 5/1989 | Cullinane | 47/67 |
| 4,951,910 | 8/1990 | March | 248/311.2 |
| 5,117,779 | 6/1992 | Karow | 119/69.5 |
| 5,220,744 | 6/1993 | Kendall | 47/39 |
| 5,244,175 | 9/1993 | Frankel | 248/215 |
| 5,249,770 | 10/1993 | Louthan | 248/311.2 |
| 5,279,452 | 1/1994 | Huynh | 224/42.45 |
| 5,332,090 | 7/1994 | Tucker | 206/315.3 |
| 5,335,888 | 8/1994 | Thomsen | 248/118.5 |
| 5,450,690 | 9/1995 | Elsea | 47/41.01 |
| 5,456,046 | 10/1995 | Vitalune et al. | 47/41.01 |
| 5,501,889 | 3/1996 | Church | 428/66.5 |
| 5,573,211 | 11/1996 | Wu | 248/96 |
| 5,593,121 | 1/1997 | Tackett | 248/218.4 |
| 5,622,346 | 4/1997 | Story, Jr. | 248/311.2 |
| 5,685,103 | 11/1997 | Wiggins | 42/94 |
| 5,702,081 | 12/1997 | Gallemore, II | 248/218.4 |
| 5,732,915 | 3/1998 | Heard | 248/219.4 |
| 5,752,685 | 5/1998 | Tyan | 248/218.4 |
| 5,755,343 | 5/1998 | Harvey, Sr. | 211/90.01 |
| 5,762,308 | 6/1998 | Bryan | 248/314 |
| 5,833,188 | 11/1998 | Stiddiford et al. | 248/229.17 |
| 5,857,651 | 1/1999 | Kunevicus | 248/230.8 |

*Primary Examiner*—Michael J. Carone
*Assistant Examiner*—Fredrick T. French, III

[57] ABSTRACT

An attachment apparatus is provided for supporting a flower holder module on a cylindrical support and includes a module holder portion. A transverse bridge member includes a proximal end which is connected to a bottom portion of the module holder portion. A strap support member is connected to a distal end of the bridge member. The strap support member includes a first strap reception channel. A first flexible strap is threaded through the first strap reception channel. A first fastener assembly is connected to the first flexible strap. The strap support member further includes a second strap reception channel located above the first strap reception channel. A second flexible strap is threaded through the second strap reception channel, and a second fastener assembly is connected to the second flexible strap. Each of the first fastener assembly and the second fastener assembly includes an inside hook-or-loop material located on an inside surface of the respective flexible strap and includes a complimentary loop-or-hook material on an outside surface of the respective flexible strap. In addition, each of the first flexible strap and the second flexible strap can include a quantity of relatively high friction rubber material on a respective inside strap surface. Each of the first flexible strap and the second flexible strap is wrapped around the cylindrical support, and the hook-or-loop material is attached to the complimentary loop-or-hook material to secure the attachment apparatus to the cylindrical support.

9 Claims, 3 Drawing Sheets

FIG 3
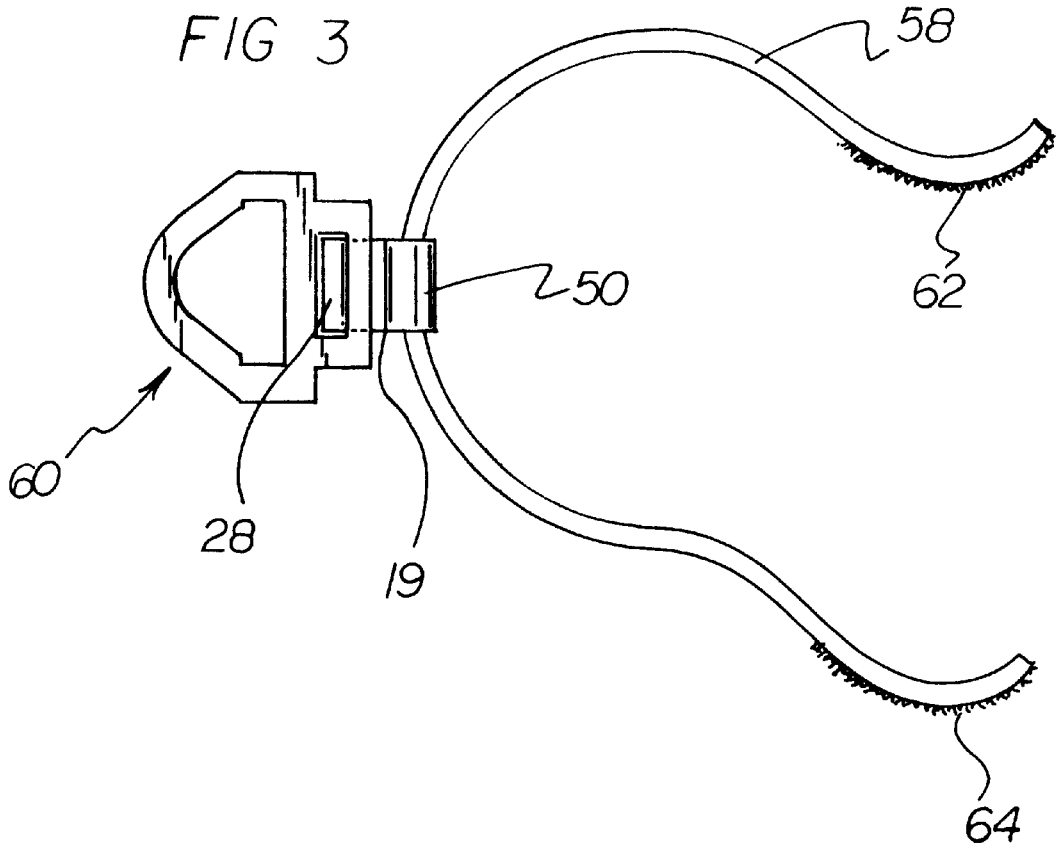
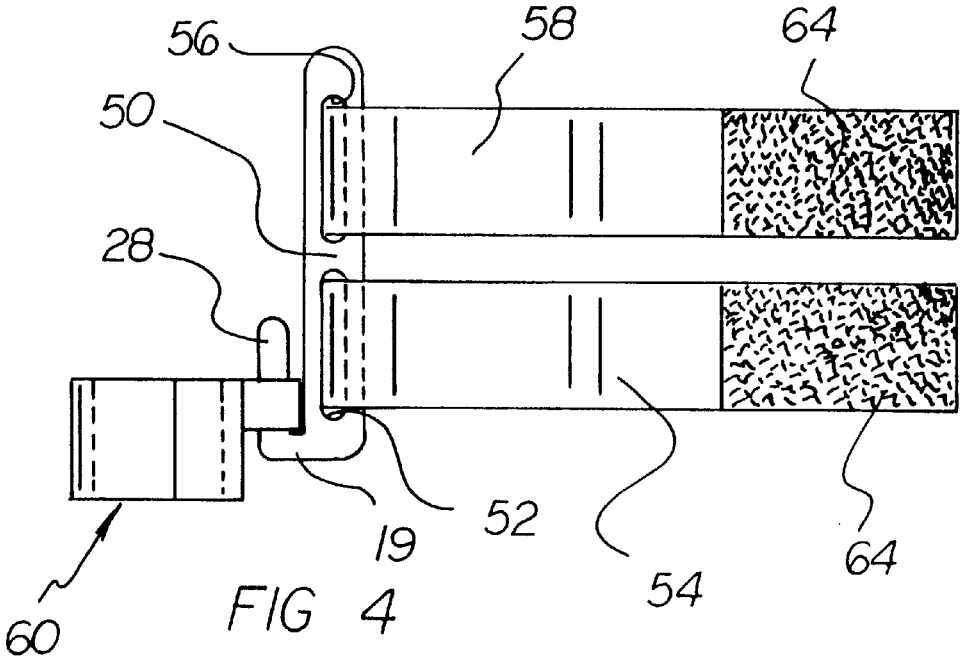
FIG 4

ATTACHMENT APPARATUS FOR A FLOWER HOLDER MODULE

BACKGROUND OF THE INVENTION

1. Field of the Invention

The present invention relates generally to flower holder modules and, more particularly, to devices especially adapted for attaching flower holder modules to a cylindrical support.

2. Description of the Prior Art

A bouquet display apparatus, by the same inventor hereof, is disclosed in U.S. Pat. No. 5,456,046, incorporated herein by reference, which includes an adjustable clamp assembly 12 and a bracket assembly 26 supported by the adjustable clamp assembly 12, wherein the bracket assembly 26 includes a module holder portion 28. In a patent application, Ser. No. 09/049,703, filed Mar. 28, 1998 incorporated herein by reference, by the same inventor hereof, a flower holder module 60 is disclosed which is supported by the module holder portion 28 of the bracket assembly 26. The flower holder module 60 is known as a "vit". A bouquet holder which includes a plastic handle and foam secured to the top for placing fresh or artificial flowers in it, can also be used with a "vit". In both the patent and the patent application mentioned above, the flower holder or the bouquet holder are attached to an underlying support, such as a table top, by the use of an adjustable clamp assembly 12. The adjustable clamp assembly 12 is especially useful for supporting the flower holder or bouquet holder on a planar, horizontally oriented support, such as a table top. However, the adjustable clamp assembly 12 may provide only a relatively unstable support if the adjustable clamp assembly 12 is attached to a cylindrical support, such as a round table leg, a pole, a fence, a lamp, a railing, or a bannister. In this respect, it would be desirable if an attachment apparatus for a flower holder module (vit) were provided that is useful for providing a stable attachment to a cylindrical support.

To aid in the stability of the gripping of the attachment apparatus for a flower holder module to a cylindrical support, it would be desirable if the attachment apparatus included a relatively high friction cylindrical-support-gripping surface.

Since flowers or bouquets that are employed with a "vit" are used only temporarily, such as for a party, wedding, or other celebration, it would be desirable if the attachment apparatus for the flower holder module were easily attached to or removed from a cylindrical support.

Cylindrical supports come in a variety of diameters. In this respect, it would be desirable if an attachment apparatus for a flower holder module were adaptable to a wide range of diameters of cylindrical supports.

After an attachment apparatus for a flower holder module has been used many times, portions of the attachment apparatus may wear out and need replacement. In this respect, it would be desirable if an attachment apparatus for a flower holder module included parts that are readily removable and replaceable.

When a bunch of flowers or a bouquet are displayed, the beauty of the display may be enhanced with the bunch of flowers or bouquet being displayed at an adjustable angle with respect to a cylindrical support. In this respect, it would be desirable if an attachment apparatus for a flower holder module were provided which permits a range of variation in a display angle with respect to a cylindrical support.

Thus, while the foregoing indicates it to be well known in the prior art to attach flower holder modules ("vits") to underlying supports, the prior art described above does not teach or suggest an attachment apparatus for a flower holder module which has the following combination of desirable features: (1) provides a stable attachment to a cylindrical support; (2) includes a relatively high friction cylindrical-support-gripping surface; (3) is easily attached to or removed from a cylindrical support; (4) is adaptable to a wide range of diameters of cylindrical supports; (5) includes parts that are readily removable and replaceable; and (6) permits a range of variation in a display angle with respect to a cylindrical support. The foregoing desired characteristics are provided by the unique attachment apparatus for a flower holder module of the present invention as will be made apparent from the following description thereof. Other advantages of the present invention over the prior art also will be rendered evident.

SUMMARY OF THE INVENTION

To achieve the foregoing and other advantages, the present invention, briefly described, provides an attachment apparatus for supporting a flower holder module on a cylindrical support. The attachment apparatus includes a module holder portion. A transverse bridge member includes a proximal end which is connected to a bottom portion of the module holder portion. A strap support member is connected to a distal end of the bridge member. The strap support member includes a first strap reception channel. A first flexible strap is threaded through the first strap reception channel. A first fastener assembly is connected to the first flexible strap. The strap support member further includes a second strap reception channel located above the first strap reception channel. A second flexible strap is threaded through the second strap reception channel, and a second fastener assembly is connected to the second flexible strap.

Each of the first fastener assembly and the second fastener assembly includes an inside fastening structure located on an inside surface of the respective flexible strap and includes a complimentary outside fastening structure on an outside surface of the respective flexible strap. The inside fastening structure is a quantity of hook-or-loop material, and the outside fastening structure is a quantity of complimentary loop-or-hook material. In addition. Each of the first flexible strap and the second flexible strap includes a quantity of relatively high friction material on a respective inside strap surface. The high friction material can be rubber material.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved attachment apparatus for a flower holder module which has all of the advantages of the prior art and none of the disadvantages.

It is another object of the present invention to provide a new and improved attachment apparatus for a flower holder module which may be easily and efficiently manufactured and marketed.

It is a further object of the present invention to provide a new and improved attachment apparatus for a flower holder module which is of durable and reliable construction.

An even further object of the present invention is to provide a new and improved attachment apparatus for a flower holder module which is susceptible of a low cost of manufacture with regard to both materials and labor, and which accordingly is then susceptible of low prices of sale to the consuming public, thereby making such attachment apparatus for a flower holder module available to the buying public.

Still yet a further object of the present invention is to provide a new and improved attachment apparatus for a flower holder module which provides a stable attachment to a cylindrical support.

Still another object of the present invention is to provide a new and improved attachment apparatus for a flower holder module that includes a relatively high friction cylindrical-support-gripping surface.

Yet another object of the present invention is to provide a new and improved attachment apparatus for a flower holder module which is easily attached to or removed from a cylindrical support.

Even another object of the present invention is to provide a new and improved attachment apparatus for a flower holder module that is adaptable to a wide range of diameters of cylindrical supports.

Still a further object of the present invention is to provide a new and improved attachment apparatus for a flower holder module which includes parts that are readily removable and replaceable.

Yet another object of the present invention is to provide a new and improved attachment apparatus for a flower holder module that permits a range of variation in a display angle with respect to a cylindrical support.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a top view of the embodiment of the invention shown in FIG. 2 with the attachment straps shown in an open mode.

FIG. 4 is a side view of the embodiment of the invention shown in FIG. 3 with the attachment straps shown in an open mode.

DESCRIPTION OF THE PREFERRED EMBODIMENT

Figure 1:
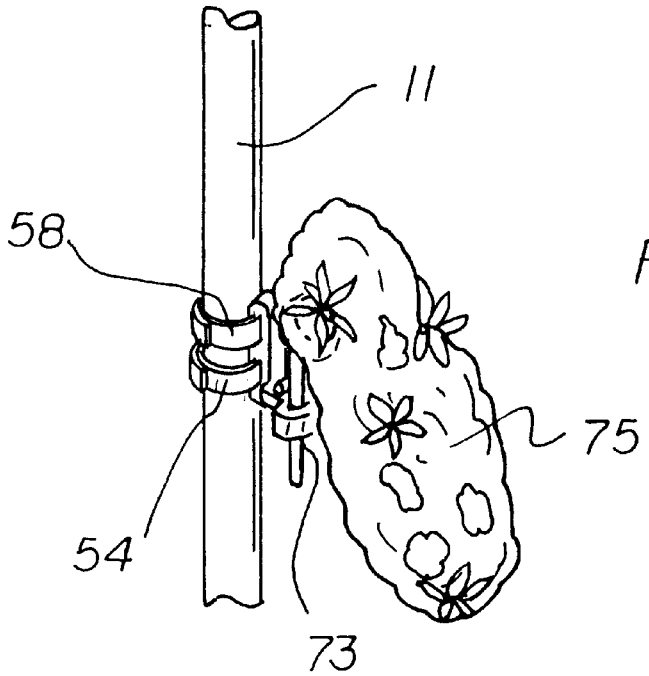
FIG. 1 is a perspective view showing a preferred embodiment of the attachment apparatus for a flower holder module of the invention attached to a pole and used for supporting a bouquet holder which is supporting a bouquet.
Figure 2:
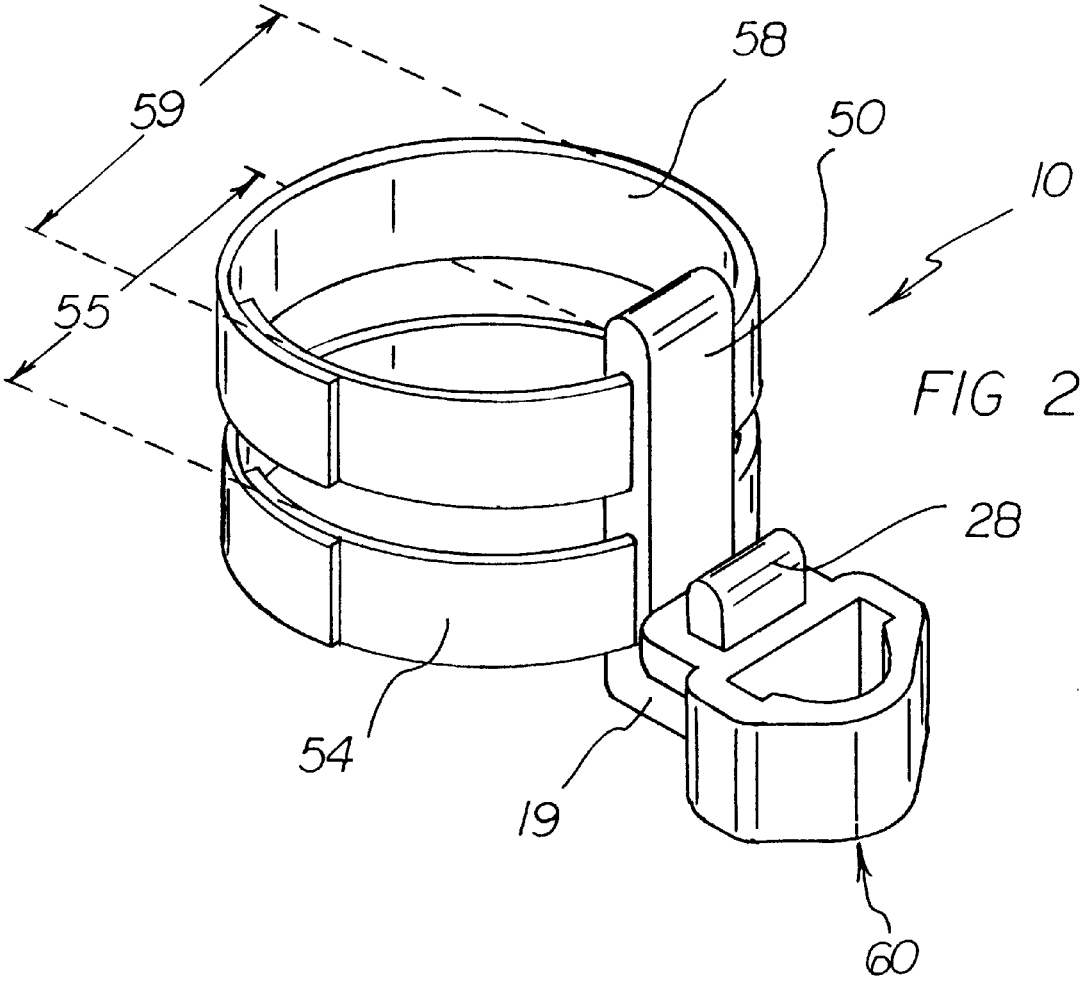
FIG. 2 is an enlarged perspective view of the embodiment of the attachment apparatus for a flower holder module shown in FIG. 1 removed from the pole and devoid of the bouquet holder and bouquet which have been removed, wherein attachment straps are shown in a secured mode.
Figure 5:
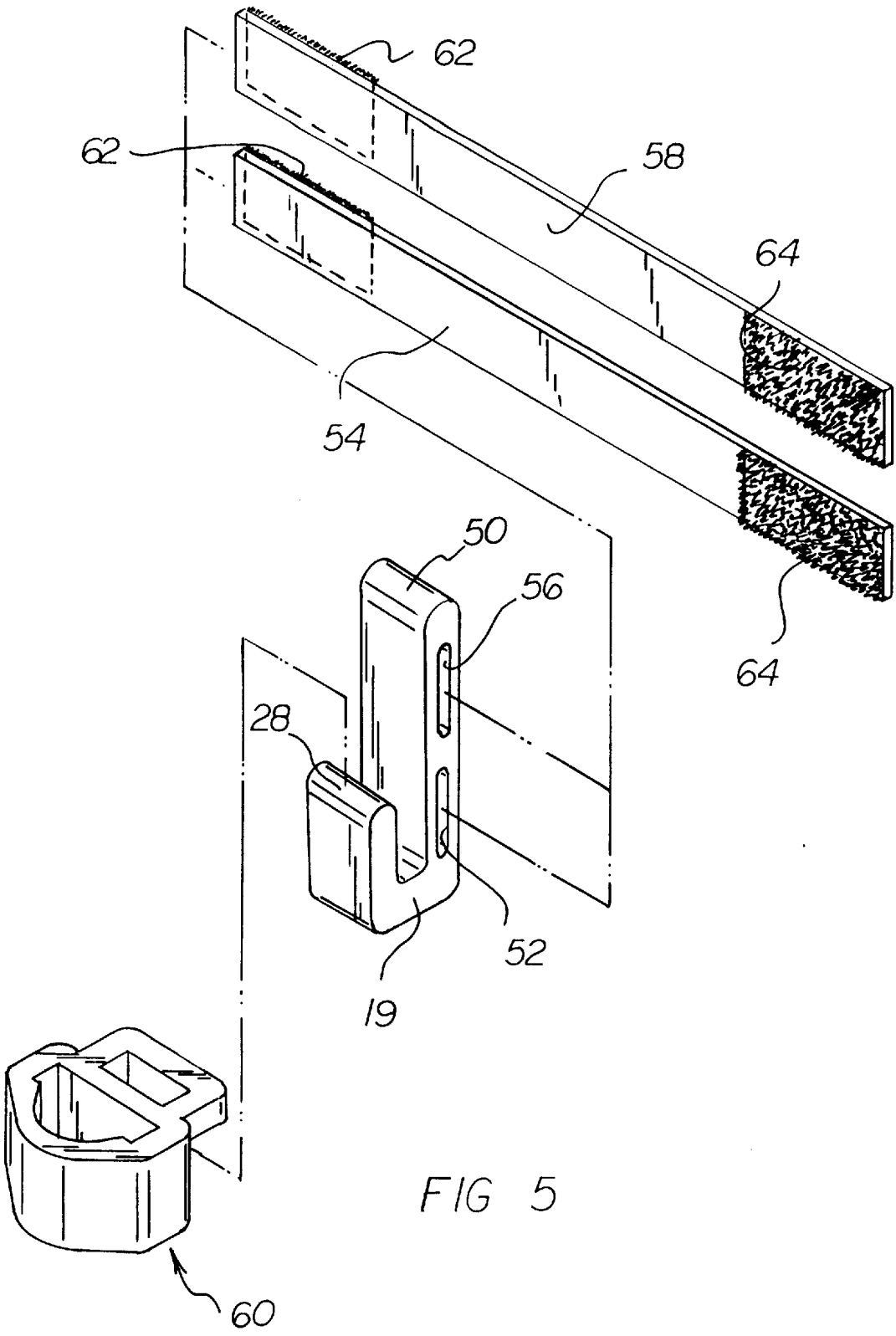
FIG. 5 is an exploded perspective view of the embodiment of the invention shown in FIGS. 1–4.

With reference to the drawings, a new and improved attachment apparatus for a flower holder module embodying the principles and concepts of the present invention will be described.

Turning to FIGS. 1–5, there is shown an exemplary embodiment of the attachment apparatus for a flower holder module of the invention generally designated by reference numeral 10. In its preferred form, attachment apparatus 10 is provided for supporting a flower holder module 60 on a cylindrical support 11. The attachment apparatus 10 includes a module holder portion 28. A transverse bridge member 19 includes a proximal end which is connected to a bottom portion of the module holder portion 28. A strap support member 50 is connected to a distal end of the bridge member 19. The strap support member 50 includes a first strap reception channel 52. A first flexible strap 54 is threaded through the first strap reception channel 52. A first fastener assembly is connected to the first flexible strap 54. The strap support member 50 further includes a second strap reception channel 56 located above the first strap reception channel 52. A second flexible strap 58 is threaded through the second strap reception channel 56, and a second fastener assembly is connected to the second flexible strap 58.

Each of the first fastener assembly and the second fastener assembly includes an inside fastening structure located on an inside surface of the respective flexible strap and includes a complimentary outside fastening structure on an outside surface of the respective flexible strap. The inside fastening structure is a quantity of hook-or-loop material 62, and the outside fastening structure is a quantity of complimentary loop-or-hook material 64. The hook-or-loop material 62 and the complimentary loop-or-hook material 64 are made from well known VELCRO(TM) material. In addition. Each of the first flexible strap 54 and the second flexible strap 58 includes a quantity of relatively high friction material on a respective inside strap surface. The high friction material can be rubber material.

To use the attachment apparatus 10 of the invention, the first flexible strap 54 is threaded through the first strap reception channel 52, and the second flexible strap 58 is threaded through the second strap reception channel 56. Then, a cylindrical support 11, such as pole 11 in FIG. 1, is selected. The first flexible strap 54 is wrapped around the cylindrical support 11, and the hook-or-loop material 62 is attached to the complimentary loop-or-hook material 64 to secure the first flexible strap 54 to the cylindrical support 11. Then, the second flexible strap 58 is wrapped around the cylindrical support 11, and the respective hook-or-loop material 62 is attached to the respective complimentary loop-or-hook material 64 to secure the second flexible strap 58 to the cylindrical support 11.

If desired, the second flexible strap 58 can be wrapped around the cylindrical support 11 so that it is looser on the cylindrical support 11 than the first flexible strap 54. Stated somewhat differently, the first flexible strap 54 forms a first circle that has a first diameter 55. The second flexible strap 58 forms a second circle that has a second diameter 59. With the second flexible strap 58 looser on the cylindrical support 11 than the first flexible strap 54, the second diameter 59 is larger than the first diameter 55. When this is the case, the attachment apparatus 10 can lean away from the cylindrical support 11. That is, when a flower holder module 60 is supported the module holder portion 28, when a bouquet holder 73 is installed in the flower holder module 60, and when a bouquet 75 is supported by the bouquet holder 73, the bouquet 75 and the bouquet holder 73 can lean away from the cylindrical support 11 when the second diameter 59 greater than the first diameter 55.

More generally, the angle of lean of a bouquet 75 and a bouquet holder 73 with respect to a cylindrical support 11 can be determined by a disparity between the second diameter 59 of the second flexible strap 58 and the first diameter 55 of the first flexible strap 54. By leaning a bouquet 75 away from a cylindrical support 11, the bouquet 75 can be prevented from is damaged by the cylindrical support 11.

Besides the pole 11, other cylindrical supports can be employed such as candelabras, fences, lamps, product display boards, railings, and banisters. More generally, the cylindrical support 11 can be either horizontally oriented, vertically oriented, or oriented at an intermediate angle.

If the first flexible strap 54 and the second flexible strap 58 get overly worn, they can be easily removed by unthreading them from the respective strap reception channels. Then, new straps can be rethreaded.

The components of the attachment apparatus for a flower holder module of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved attachment apparatus for a flower holder module that is low in cost, relatively simple in design and operation, and which may advantageously be used to provide a stable attachment to a cylindrical support. With the invention, an attachment apparatus for a flower holder module is provided which includes a relatively high friction cylindrical-support-gripping surface. With the invention, an attachment apparatus for a flower holder module is provided which is easily attached to or removed from a cylindrical support. With the invention, an attachment apparatus for a flower holder module is provided which is adaptable to a wide range of diameters of cylindrical supports. With the invention, an attachment apparatus for a flower holder module is provided which includes parts that are readily removable and replaceable. With the invention, an attachment apparatus for a flower holder module is provided which permits a range of variation in a display angle with respect to a cylindrical support.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An attachment apparatus for supporting a flower holder module on a support wherein said flower holder module is adapted to removably receive therein a floral bouquet, said apparatus comprising:

a strap support member and an L-shaped module holder portion, said L-shaped module holder portion including an end portion for engagingly receiving said flower holder module and a transverse bridge member orthogonally extending with respect to said L-shaped module holder portion end portion upon which a portion of said flower holder module is adapted to rest, said strap support member being connected to a distal end of said transverse bridge member such that said strap support member extends parallel to said L-shaped module holder portion end portion and has a longitudinal extent extending beyond that of said L-shaped module holder portion end portion, wherein said strap support member includes a first strap reception channel, a first flexible strap removably threaded through said first strap reception channel, and a first fastener assembly connected to said first flexible strap.

2. The apparatus of claim 1 wherein said strap support member further includes a second strap reception channel spaced from said first strap reception channel.

3. The apparatus of claim 2, further including:

a second flexible strap threaded through said second strap reception channel, and a second fastener assembly connected to said second flexible strap.

4. The apparatus of claim 3 wherein each of said first fastener assembly and said second fastener assembly includes:

an inside fastening structure located on an inside surface of each of said first and second flexible straps, respectively, and a complimentary outside fastening structure on an outside surface of each of said first and second flexible straps, respectively.

5. The apparatus of claim 4 wherein:

said inside fastening structure is a quantity of hook-or-loop material, and said complimentary outside fastening structure is a quantity of complimentary loop-or-hook material.

6. The apparatus of claim 1 wherein each of said first flexible strap and said second flexible strap includes a quantity of relatively high friction material on a respective inside strap surface.

7. The apparatus of claim 6 wherein said quantity of relatively high friction material can be rubber material.

8. The apparatus of claim 1 in combination with said flower holder module wherein said flower holder module comprises:

an attachment portion which includes a bracket attachment frame and a bracket attachment channel defined by said bracket attachment frame, and a bouquet retention portion connected to said attachment portion, wherein said bouquet retention portion includes a bouquet retention frame and bouquet retention channel defined by said bouquet retention frame.

9. The combination of claim 8 wherein said wherein said bouquet retention frame includes a planar first interior wall, a planar second interior wall projecting perpendicularly from a first end of said planar first interior wall, a planar third interior wall projecting perpendicularly from a second end of said planar first interior wall, a planar fourth interior wall projecting inward and perpendicular from said planar second interior wall, a planar fifth interior wall projecting inward and perpendicular from said planar third interior wall, and a curved sixth interior wall extending from an innermost end of said planar fourth interior wall to an innermost end of said planar fifth interior wall.

* * * * *